US010405115B1

(12) United States Patent
Landron et al.

(10) Patent No.: US 10,405,115 B1
(45) Date of Patent: Sep. 3, 2019

(54) FAULT DETECTION FOR MICROPHONE ARRAY

(71) Applicant: MOTOROLA SOLUTIONS, INC., Chicago, IL (US)

(72) Inventors: Daniel Landron, Sunrise, FL (US); Kurt S. Fienberg, Plantation, FL (US)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 28 days.

(21) Appl. No.: 15/940,293

(22) Filed: Mar. 29, 2018

(51) Int. Cl.
*H04R 29/00* (2006.01)

(52) U.S. Cl.
CPC ..... *H04R 29/005* (2013.01); *H04R 29/004* (2013.01); *H04R 29/007* (2013.01); *H04R 2410/07* (2013.01)

(58) Field of Classification Search
CPC ..... H04R 3/00; H04R 3/002; H04R 3/005; H04R 9/08; H04R 11/04; H04R 17/02; H04R 19/04; H04R 21/02; H04R 21/021; H04R 21/023; H04R 21/025; H04R 21/026; H04R 21/028; H04R 2410/00; H04R 2410/01; H04R 2410/03; H04R 2410/05; H04R 2410/07
USPC ..... 381/23.1, 71.6, 71.7, 74, 111, 112, 113, 381/166, 174, 175, 312, 317, 322, 324, 381/330, 335, 369
See application file for complete search history.

(56) References Cited

U.S. PATENT DOCUMENTS 3,854,117 A * 12/1974 Fothergill ..... G01S 3/48 367/125
8,379,876 B2 * 2/2013 Zhang ..... H04R 29/005 381/58
8,391,524 B2 * 3/2013 Gozen ..... H04R 25/505 381/312
9,635,481 B2 * 4/2017 Matsumoto ..... H04R 29/004
10,182,291 B2 * 1/2019 Kanamori ..... H04R 3/005
2002/0031234 A1 * 3/2002 Wenger ..... H04R 1/406 381/86
2004/0175006 A1 * 9/2004 Kim ..... H04R 1/406 381/92
2005/0175187 A1 * 8/2005 Wright ..... G10K 11/178 381/71.12
2011/0293103 A1 * 12/2011 Park ..... G10L 21/0208 381/57
2014/0098972 A1 * 4/2014 Yamada ..... H04R 29/006 381/92

(Continued)

OTHER PUBLICATIONS

Madhu, N. et al.: "Low-complexity, robust algorithm for sensor anomaly detection and self-calibration of microphone arrays", IET Signal Processing, www.ietdl.org, Jun. 30, 2009, revised May 10, 2010, doi: 10.1049/iet-spr.2009.0164, all pages.

*Primary Examiner* — Khai N. Nguyen
(74) *Attorney, Agent, or Firm* — Barbara R. Doutre

(57) ABSTRACT

Reliable detection of a microphone failure along with corrective action are provided for a portable communication device having multiple microphones. The faulty microphone detection uses a correlation based metric between three (3) or more microphones. The approach is based on full cross correlation, including phase as well as magnitude, between unique microphone pairs for isolating a faulty microphone condition. The approach allows for the determination of precisely which microphone has failed and minimizes false triggers under windy conditions within a microphone array.

18 Claims, 7 Drawing Sheets

(56) References Cited

U.S. PATENT DOCUMENTS

| | | | | |
|---|---|---|---|---|
| 2016/0037277 | A1* | 2/2016 | Matsumoto | H04R 29/004 381/58 |
| 2018/0249247 | A1* | 8/2018 | Kanamori | H04R 3/005 |

* cited by examiner

302

TAGS

| | MIC1 | MIC2 | MIC3 |
|---|---|---|---|
| MIC1 | X | G | B |
| MIC2 | X | X | B |
| MIC3 | X | X | X |

304

AMM

| | MIC1 | MIC2 | MIC3 |
|---|---|---|---|
| MIC1 | X | G | B |
| MIC2 | X | X | B |
| MIC3 | X | X | X |

306

IMM

| | MIC1 | MIC2 | MIC3 |
|---|---|---|---|
| MIC1 | X | G | B |
| MIC2 | X | X | B |
| MIC3 | X | X | X |

300

FIG. 3A

312

TAGS

| | MIC1 | MIC2 | MIC3 |
|---|---|---|---|
| MIC1 | X | G | G |
| MIC2 | X | X | B |
| MIC3 | X | X | X |

314

AMM

| | MIC1 | MIC2 | MIC3 |
|---|---|---|---|
| MIC1 | X | G | G |
| MIC2 | X | X | B |
| MIC3 | X | X | X |

310

FIG. 3B

322

TAGS

| | MIC1 | MIC2 | MIC3 |
|---|---|---|---|
| MIC1 | X | U(OR B) | B |
| MIC2 | X | X | B |
| MIC3 | X | X | X |

324

AMM

| | MIC1 | MIC2 | MIC3 |
|---|---|---|---|
| MIC1 | X | U(OR B) | B |
| MIC2 | X | X | B |
| MIC3 | X | X | X |

326

IMM

| | MIC1 | MIC2 | MIC3 |
|---|---|---|---|
| MIC1 | X | U(OR B) | B |
| MIC2 | X | X | B |
| MIC3 | X | X | X |

320

FIG. 3C

332

TAGS

| | MIC1 | MIC2 | MIC3 |
|---|---|---|---|
| MIC1 | X | G | U |
| MIC2 | X | X | B |
| MIC3 | X | X | X |

334

AMM

| | MIC1 | MIC2 | MIC3 |
|---|---|---|---|
| MIC1 | X | G | U |
| MIC2 | X | X | B |
| MIC3 | X | X | X |

336

IMM

| | MIC1 | MIC2 | MIC3 |
|---|---|---|---|
| MIC1 | X | G | U |
| MIC2 | X | X | B |
| MIC3 | X | X | X |

330

FIG. 3D

FAULT DETECTION FOR MICROPHONE ARRAY

TECHNICAL FIELD

The present application relates to microphone arrays and more particularly to fault detection for a microphone array of a portable communication device.

BACKGROUND

Portable communication devices, particularly those used in public safety applications, may incorporate a microphone array to provide improved audio communication. Such portable communication devices are often required to operate under robust environmental conditions, including high noise and windy environments. There is a need for detecting bad, faulty, or plugged microphone conditions, as such conditions can cause a microphone to go into a state of emitting high levels of static noise. Traditional energy based failure detectors can be tricked if the microphone failure results in a significantly loud noise or static signal being fed to the audio processing chain. If not properly managed, such static can impede the device's ability to communicate. For example, in an audio-video recording device, such static may cause a noisy recording. Unfortunately, past energy based schemes for detecting a faulty microphone have tended to create false triggers, and wind noise is one such false trigger.

Accordingly, it would be desirable to provide improved fault detection of a microphone array that avoids false triggers, particularly false triggers caused by a windy environment.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

FIG. 3A is an example of a matrix representation of detection logic detecting a bad microphone in accordance with some embodiments.

FIG. 3B is an example of a matrix representation of detection logic detecting a good microphone in accordance with some embodiments.

FIG. 3C is an example of a matrix representation of detection logic detecting a good microphone subjected to windy conditions in accordance with some embodiments.

FIG. 3D is an example of a matrix representation of detection logic detecting a good microphone subjected to non-windy conditions in accordance with some embodiments.

Figure 1:
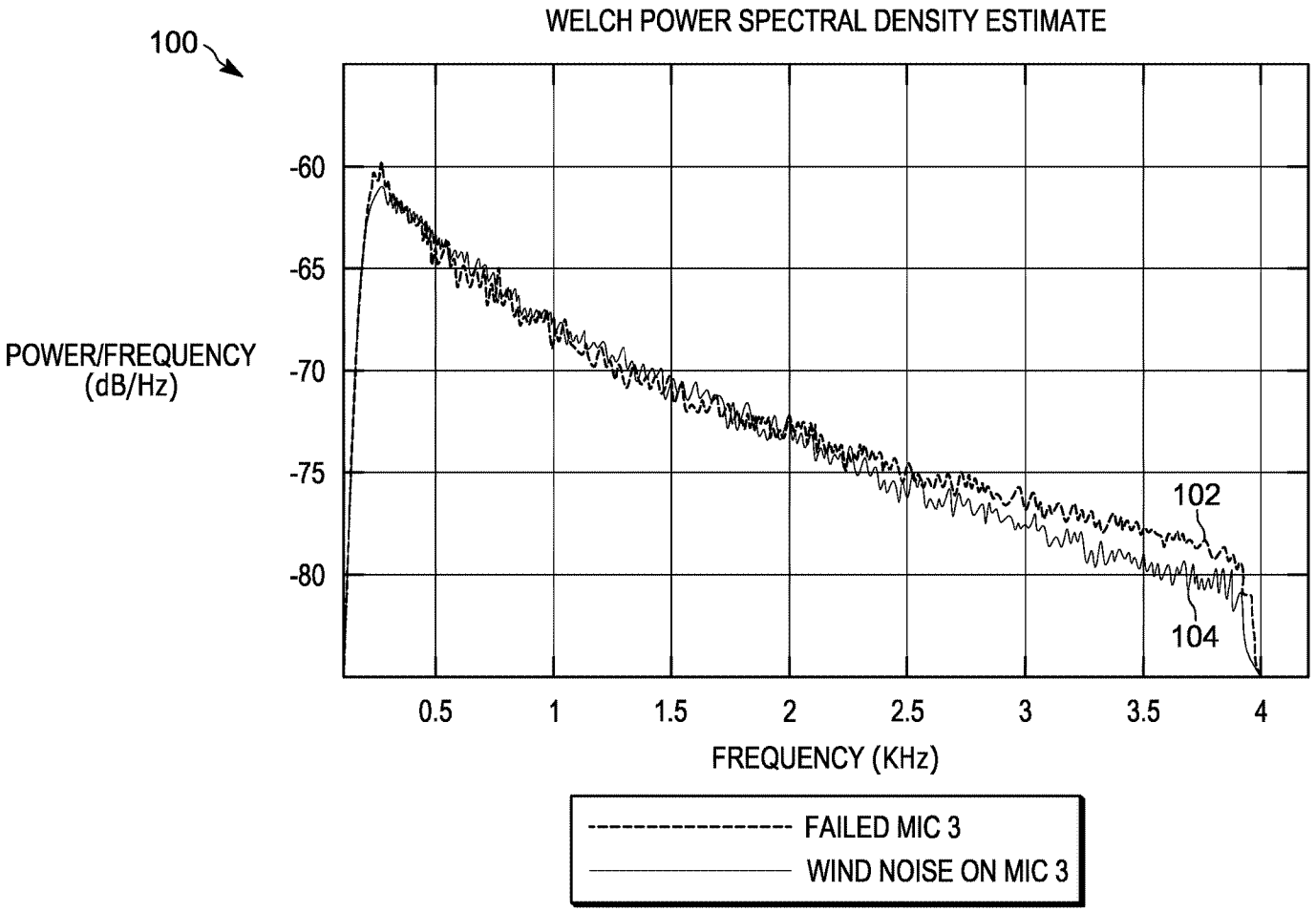
FIG. 1 is a graph showing similarities between a faulty microphone and non-faulty microphone subject to wind noise.

The apparatus and method components have been represented where appropriate by conventional symbols in the drawings, showing only those specific details that are pertinent to understanding the embodiments shown so as not to obscure the disclosure with details that will be readily apparent to those of ordinary skill in the art having the benefit of the description herein. Other elements, such as those known to one of skill in the art, may thus be present.

DETAILED DESCRIPTION

Briefly, there is provided herein a method and apparatus for detecting a faulty microphone within a microphone array of a portable communication device. A microphone failure can manifest itself in different forms: no audio at all, the level being very low, or the audio signal being extremely noisy, or any level in between. Failure modes may result in a very loud static noise on the microphone signal. FIG. 1 is a graph 100 showing two power spectral densities 102, 104 comparing 30 seconds of audio recording for a portable communication device in which a microphone (mic3) failed 104, as compared to 30 seconds of data for a similar device (having all good microphones mics) in wind 102. Power spectral densities 102, 104 have been normalized for absolute level. As can be seen from the graph 100, the power spectral densities (PDSs) between the faulty microphone 104 and the non-faulty microphone 102 subject to wind noise are very similar. Hence, the use of signal power for failure detection makes it difficult to distinguish between a faulty microphone and a working microphone being subjected to wind noise. In accordance with the embodiments, reliable detection of a microphone failure is provided along with corrective action for a device with multiple microphones. The noisy microphone detector provided herein uses a correlation based metric between three (3) or more microphones to determine if a microphone has a noisy or 'staticky' failure mode. The approach allows for the determination of precisely which microphone has failed and is further robust against windy conditions thereby minimizing false failure detections under windy conditions.

The approach provided by the embodiments is based on full cross correlation, including phase as well as magnitude, between microphone pairs for isolating a single faulty microphone condition as well as multiple faulty microphone conditions. The approach has been tested under a wide range of wind conditions and has been shown to avoid false triggers thereby providing improved reliability over past faulty microphone detection schemes.

Figure 2:
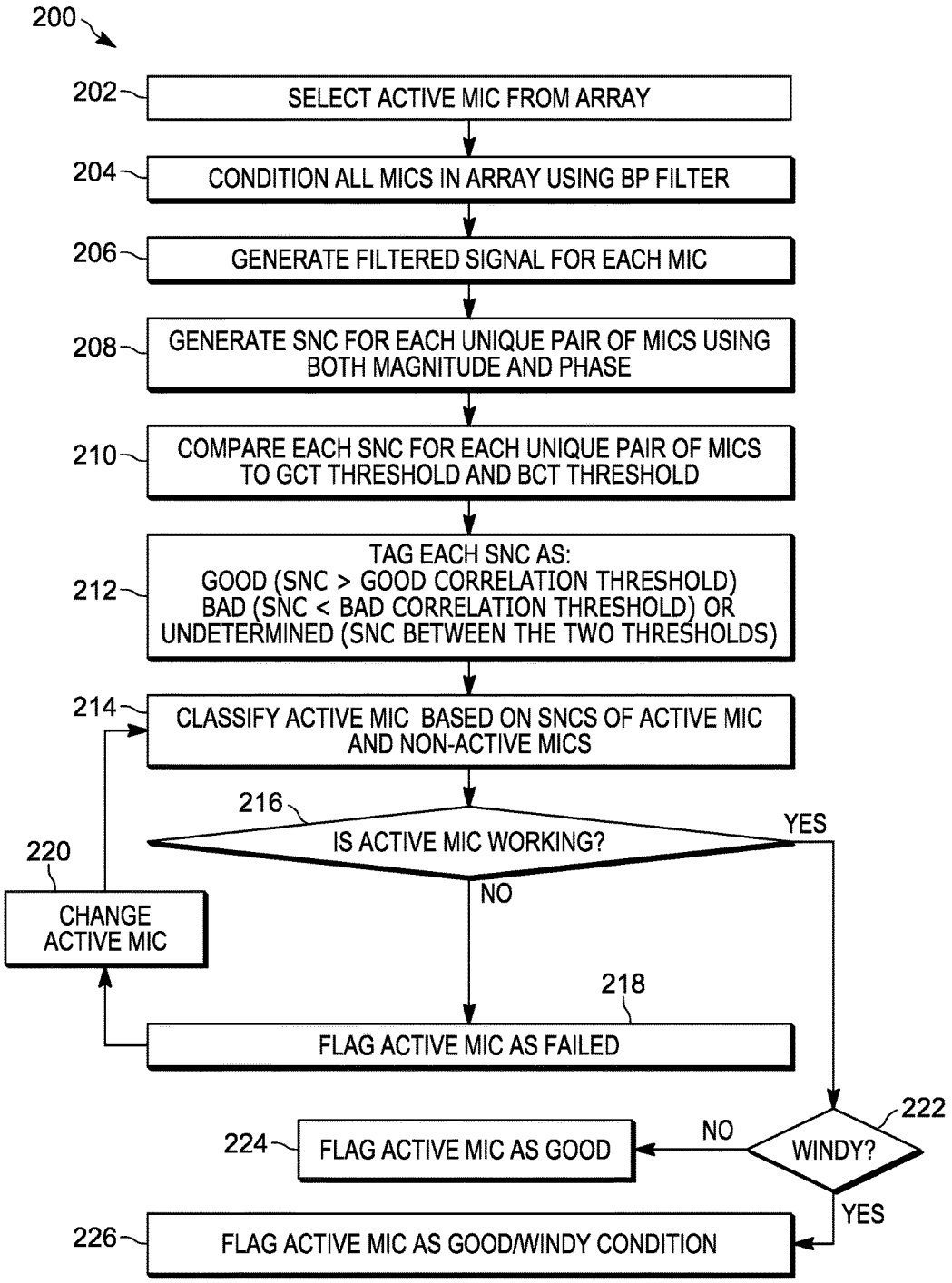
FIG. 2 is a flowchart of a method for detecting a faulty microphone in accordance with some embodiments.

FIG. 2 is a flowchart of a method 200 for detecting a faulty microphone in a microphone array of a portable communication device in accordance with some embodiments. Method 200 begins at 202 by selecting an active microphone from an array of microphones, wherein the array of microphones comprises at least three microphones. At 204, conditioning all of the microphones in the array takes place using a bandpass filter that removes DC at predetermined lower frequencies and removes predetermined uncorrelated frequency components at predetermined upper frequencies, thereby generating a filtered signal for each microphone at 206.

In accordance with the embodiments, the method continues at 208 by generating a smoothed normalized correlation (SNC) for each unique pair of microphones within the array, wherein the correlation is a true cross correlation utilizing both magnitude and phase. At 210, the method proceeds by comparing each SNC for each unique pair of microphones to a predetermined good correlation threshold (GCT) and a predetermined bad correlation threshold (BCT), followed by tagging each SNC at 212 as Good, Bad, or Undetermined, wherein Good (SNC is greater that a Good Correlation Threshold), Bad (SNC is less than a Bad Correlation Threshold) or Undetermined (SNC is between the two thresholds). Using algebraic symbols the tagging case be viewed as:

GOOD (SNC>Good Correlation Threshold),

BAD (SNC<Bad Correlation Threshold), or

UNDETERMINED (Bad Correlation Threshold<SNC<Good Correlation Threshold).

The generation of the smoothed normalized correlation (SNC) for each unique pair of microphones within the array is independent of absolute energy level and relies on a normalized magnitude and phase based correlation. In accordance with preferred embodiments, the generation of the smoothed normalized correlation (SNC), at 208, may be accomplished by acquiring a number of digital audio samples in the time domain from a pair of microphones within the array, multiplying the audio samples for the two microphones together to generate a multiplication amount, retaining both magnitude and phase information for each microphone pair, calculating a mean of the multiplication amount; normalizing the calculated mean by a product of each microphone's root mean square (RMS) energy to generate a normalized result, and smoothing the normalized result with a low pass filter. The audio samples may be acquired within predetermined microphone frame boundaries, for example some microphone operations may utilize 5 ms frames. The use of microphone pairs advantageously isolates up to N-2 faulty microphones within the array, where N is the number of microphones in the array.

In accordance with the embodiments, classification of the active microphone takes place at 214. The active microphone may be classified as a failed microphone or a working microphone, as will be described later. A failed active microphone is detected at 216, flagged at 218, and then a new active microphone is transitioned in at 220 for reclassification at 214. In some embodiments, the new active microphone may be selected based on a priority list. The feedback loop formed of 214, 216, 218, and 220 may be repeated until a working active microphone is detected at 216.

In accordance with the embodiments, the classification of a working active microphone at 214 is detected at 216 and further classified as being windy or non-windy at 222, and flagged as good/non-windy at 224 or flagged as being good/windy at 226. Active microphones flagged as good/non-windy or good/windy remain in operation, whereas active microphones flagged as failed are switched out.

In accordance with the embodiments, the classification of the active microphone at 214 is based on SNCS of the active microphone and SNCS of the non-active microphones in order to cover several scenarios of microphone conditions. In a first scenario, a failed microphone determination is made when all tagged SNCs involving the active microphone are tagged as being BAD, but at least one of the other SNCs, involving the non-active microphone, is tagged as being GOOD. In a second scenario, a working good microphone determination is made when at least one tagged SNCs involving the active microphone is tagged as GOOD. In a third scenario, a working good microphone operating under windy conditions is made when all tagged SNCs involving the active microphone are tagged as BAD, and the SNCs involving the non-active microphones do not have any tags of GOOD. In a fourth scenario, a working good microphone operating under non-windy conditions is made when at least one SNC involving the active microphone is tagged as UNDETERMINED, without any tags of GOOD. In a fifth scenario, a working good microphone operating under windy conditions is made when at least one SNC involving the active microphone is tagged as UNDETERMINED, without any tags of GOOD, and the SNCs for the non-active microphones do not have any tags of GOOD.

Accordingly, the method 200 avoids false triggering in response to wind noise. An active microphone detected as being subjected to windy conditions remains in operation, and an active microphone detected as being 'bad' is transitioned out for another microphone within the array, until an active microphone classified as a working (good) microphone is detected.

In accordance with some embodiments, the method 200 may further provide tracking and storing occurrences of failed microphones and occurrences of operational microphones subjected to wind noise thereby improving portable radio communication device analytics. For example, the method may further comprise tracking and storing flagged occurrences of failed microphones, flagged occurrences of working microphones operating under windy conditions, and flagged occurrences of working microphones operating in non-windy conditions as part of controller analytics of a portable radio communication device.

FIGS. 3A, 3B, 3C, 3D show examples of a matrix representation for detection logic used in tagging and classifying a microphone array in accordance with some embodiments. The microphone array, in this example, comprises three microphones in which the third microphone (mic3) has been selected as being the active microphone. Examples are provided for bad, good, good/windy, and good/non-windy classifications.

FIG. 3A is an example of a matrix representation 300 of detection logic detecting a bad microphone in accordance with some embodiments. The matrix representation 300 is shown in three stages 302, 304, 306. At a first stage 302, the matrix shows each smoothed normalized correlation (SNC) between microphone pairs being tagged as Good (G), Bad (B) or Undetermined (U). The X means the tag for that particular pair does not contain a unique pair and is therefore not used for classification purposes. At second stage 304, the matrix row/column with the active microphone (which in this example is mic3) is masked which can be referred to as an active masked matrix (AMM). In this example, the AMM shows all tags for the active mic3 as being bad (B). If the microphone pair classifications for the active masked matrix (AMM) are all bad (B), which in this example happens to be the case, then the inverse of the mask is applied (IMM) to the matrix at third stage 306. Third stage 306 shows the inverse masked matrix (IMM) which looks at the cells of the non-active microphones (mic1), (mic2). In this example, the IMM contains at least one good (G) classification. If at least one good (G) SNC classification is found in the IMM, then the active microphone (mic3) is flagged as bad. Another microphone is then selected from the array as the active microphone and the masks are re-applied until a good microphone is found.

FIG. 3B is an example of a matrix representation 310 of detection logic detecting a good microphone in accordance with some embodiments. In this example, at a first stage 312, the matrix shows each smoothed normalized correlation (SNC) between microphone pairs being tagged as Good (G) or Bad (B). The X means the tag for that particular pair does not contain a unique pair and is therefore not used for classification purposes. At second stage 314, the matrix row/column with the active microphone (which in this example is mic3) is masked and referred to as the active masked matrix (AMM). In this example, the AMM shows at least one tag for the active mic3 as good (G). If at least one of the microphone pair classifications for the active masked matrix (AMM) is good (G), which in this example happens to be the case, then mic3 is considered good. There is no need to apply the inverse of the mask (IMM) as the active microphone, mic3, has been determined to be good.

FIG. 3C is an example of a matrix representation 320 of detection logic detecting a good microphone subjected to windy conditions in accordance with some embodiments. The matrix representation 320 is shown in three stages 322, 324, 326. At a first stage 322, the matrix shows each smoothed normalized correlation (SNC) between microphone pairs being tagged, in this case as bad (B) or undetermined (U). Under the second stage 322 with the AMM applied, the active microphone (mic3) cells are classified as bad (B). When the active microphone (mic3) is classified as bad (B) under the AMM condition, then the inverse mask (IMM) is applied at third stage 326. The third stage 326, under IMM, looks at the cells of the non-active microphones (mic1), (mic2), which in this case are either bad (B) or undetermined (U). When either bad (B) and undetermined (U) SNCs are determined in both AMM and IMM, then a wind condition is flagged and the active microphone is considered to be a good working microphone operating under a windy condition and remains in operation.

FIG. 3D is an example of a matrix representation 330 of detection logic detecting a good microphone subjected to non-windy conditions in accordance with some embodiments. The matrix representation 330 is shown in three stages 332, 334, 336. At first stage 332, the matrix shows each smoothed normalized correlation (SNC) between microphone pairs being tagged as good (G), bad (B), or undetermined (U). The X means the tag for that particular pair does not contain a unique pair and is therefore not used for classification purposes. At second stage 334, the matrix row/column with the active microphone (which in this example is mic3) is masked as active masked matrix (AMM). In this example, the AMM shows both bad (B) and undetermined (U) classifications. When the active microphone (mic3) contains at least one undetermined (U) classification under the AMM condition, then the active microphone is considered to be good. If there is no classification of good (G) under the AMM, then the inverse mask (IMM) is applied. The third stage 336 under IMM looks at the cells of the non-active microphones, which in this case shows at least one SNC classification as being good (G). When at least one good SNC classification is determined in the IMM, then the active microphone is not operating under a windy condition.

The logic for fault detection of different active microphone scenarios is summarized in the following Table:

| | |
|---|---|
| Scenario 1: | When AMM has all Bs and IMM has at least one G, then the active microphone is bad. |
| Scenario 2: | When AMM has a G, then the active microphone is good and not windy. |
| Scenario 3: | When AMM has all Bs and IMM does not have any Gs, then the active microphone is good and in a windy condition. |
| Scenario 4: | When AMM has at least one U, but no Gs, then the active microphone is considered good. If IMM has at least one G, then it is not a windy condition. |
| Scenario 5: | When AMM has at least one U, but no Gs, then the microphone is considered good. If IMM does not have any Gs, then it is in a windy condition. |

Figure 4:
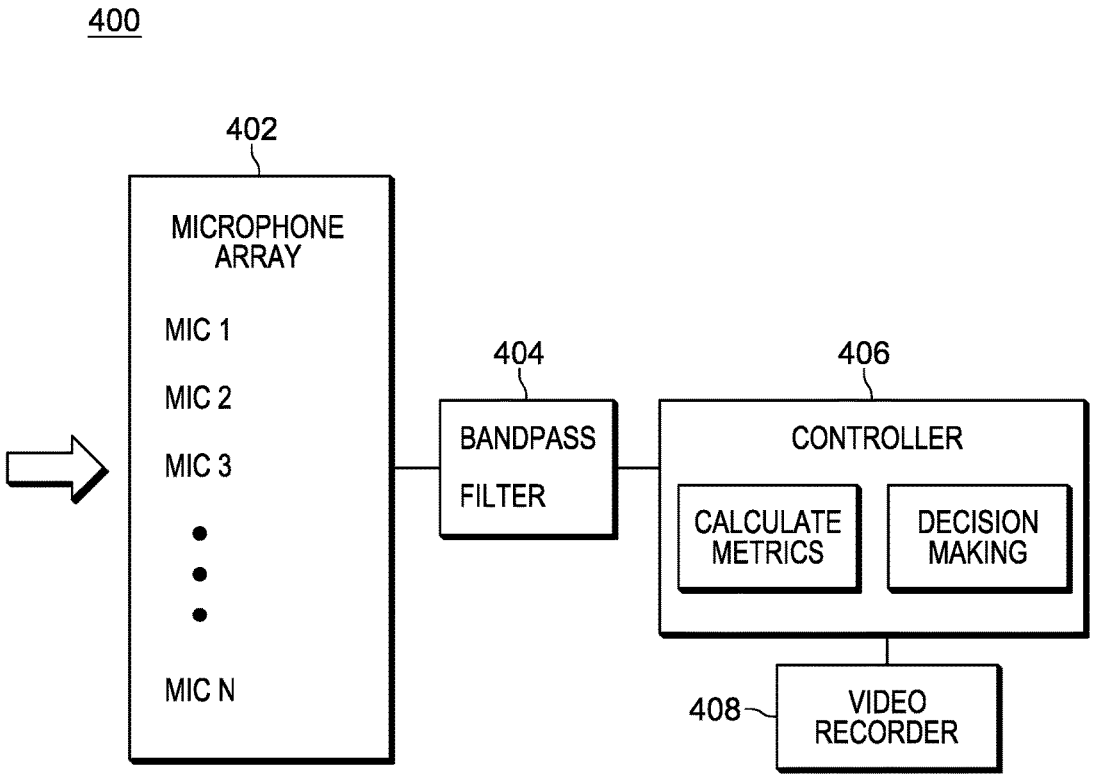
FIG. 4 is a block diagram of a portable communication device operating in accordance with some embodiments Skilled artisans will appreciate that elements in the figures are illustrated for simplicity and clarity and have not necessarily been drawn to scale. For example, the dimensions of some of the elements in the figures may be exaggerated relative to other elements to help to improve understanding of the embodiments of shown.

FIG. 4 is a block diagram of a portable radio communication device 400 operating in accordance with some embodiments. The portable communication device 400 may be a public safety communication device or some other portable radio communication device used within harsh environments, such as industrial environments where the device may be subjected to wind and noise. The portable communication device 400 comprises a microphone array 402 having at least three microphones, a controller 406 operatively coupled to the microphone array, and a bandpass filter 404 operatively coupled to the microphone array. The portable communication device 400 may further comprise a video recorder 408 operatively coupled to the controller for recording video while the microphone array records audio associated with the video.

All of the microphones in the microphone array 402 are conditioned by the bandpass filter 404 to remove DC offset at a low predetermined frequency threshold and expected uncorrelated components at a high predetermined frequency threshold thereby generating a filtered signal. The upper frequency cutoff may be governed by several factors, for example the geometry of the microphone array 402. Microphone arrays can introduce spatial aliasing at higher frequencies. This aliasing is undesired when trying to derive correlation metrics, therefore the operational frequency range needs to be set with this in mind. Generally speaking, the upper frequency cutoff may be set according to the distance between microphones in order to avoid a frequency that results in an audio wavelength shorter than twice the distance between the microphones.

In accordance with the embodiments, the controller 406 calculates metrics and generates a smoothed normalized correlation (SNC) for each unique pair of microphones within the array. For example, for three microphones the unique pairs of microphones would be (mic1, mic2), (mic1, mic3) and (mic2, mic3) and the correlation values would be SNC1.2, SNC1.3, SNC2.3 for each unique pair. In accordance with the embodiments, the SNC is a true cross correlation utilizing both magnitude and phase. The SNC, as previously described, is determined by:

- multiplying the microphone samples for the two mics in question,
- calculating the mean of the result,
- normalizing the result by the product of the microphone's root mean square (RMS) energy, and
- smoothing the result with a low pass filter.

An example shown in algebraic form for a unique pair comprising micl and mic2 would be:

$$SNC1.2(n)=SNC1.2(n-1)(1-alpha)+alpha(mean(Mic1\times Mic2)/(RMS1\times RMS2)),$$

wherein:

'n' represents the frame number,
'RMS' represents the root mean square.
'alpha' represents the smoothing constant.

In accordance with the embodiments, each SNC for each unique pair of microphones is compared to predetermined SNC correlation thresholds and tagged as a good correlation, bad correlation, or undetermined correlation, as previously described. Each SNC is compared with a Good Correlation Threshold (GCT) and a Bad Correlation Threshold (BCT). Each SNC is then tagged by controller 406 as Good (SNC>Good Correlation Threshold), Bad (SNC<Bad Correlation Threshold) or Undetermined (SNC between the two thresholds), as previously described.

In accordance with the embodiments, the controller 406 performs decision making in which the active microphone is classified as either failed or classified as an active working microphone. As previously described, the active microphone is classified as a failed microphone when all SNCs involving the active microphone are tagged as being Bad, but at least one of the SNCs, for the non-active microphones, is tagged as being Good. An active microphone is classified as a working microphone (not failed) when all the tagged SNCs for all the microphones are tagged BAD or Undetermined, or when at least one SNC with the active microphone is tagged as Good.

The controller 406, in response to detecting that the active microphone has a failed microphone classification, transitions to another microphone, making it the new active microphone, within the microphone array, until a working microphone is detected.

The controller 406 may further provide analytics to track and store flagged occurrences of failed microphones, flagged occurrences of working microphones operating under windy conditions, and flagged occurrences of working microphones operating in non-windy conditions as part of controller analytics of the portable radio communication device.

Accordingly, there has been provided an approach to faulty microphone detection that avoids false triggering from similar power spectrums that occur between a faulty microphone subjected to static noise and an operational microphone subjected to wind noise. The approach advantageously distinguishes between a failed active microphone and an active microphone subjected to wind noise. The microphone being subjected to wind noise may therefore remain operating as the active microphone. The use of phase and magnitude advantageously provides faster convergence due to twice as many data points as past techniques. The method advantageously provides detection of single or multiple failed microphones while avoiding the ambiguity caused by wind noise. Communication products can now be provisioned with audio profile downloads and thresholds which enable failure analytics. The ability to perform and track the microphone failures provides for improved radio analytics and overall improved audio performance.

The fault detection approach of the embodiments not only detects uncorrelated input for a pair of mics, but provides the additional ability of being able to pinpoint which one of the microphones is faulty, without resorting to an energy calculation. The error detection approach of the embodiments relies on correlation metrics only and calculates correlations among multiple mics (at least three) to determine which particular microphone is bad. The calculated metrics remove the variance due to energy differences, thereby making the fault detection of the embodiments 'energy independent', The use of a correlation-based signal to detect failure modes that produce high static noise is superior to approaches that only diagnose microphone failure modes based on low energy levels. The approach of the embodiments diagnoses which microphone is bad without having to rely on level scaling factors, or gain. By maintaining the phase information the approach provided by the embodiments avoids being fooled by a microphone failure that produces an uncorrelated "noise" that has an average power spectrum with the same shape as the environmental noise. The approach of the embodiments provides the advantage of being able to distinguish an actual microphone failure and a working microphone being subject to wind noise. By including both phase and magnitude information, the fault detection method can be averaged over shorter periods to arrive at a microphone failure decision sooner, based on faster convergence.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The invention claimed is:

1. A method for detecting a faulty microphone in a microphone array of a communication device, comprising:

selecting an active microphone from an array of microphones, wherein the array of microphones comprises at least three microphones;

conditioning all of the microphones in the array using a bandpass filter that removes DC (Direct Current) at predetermined lower frequencies and removes predetermined uncorrelated frequency components at predetermined upper frequencies, thereby generating a filtered signal for each microphone;

generating a smoothed normalized correlation (SNC) for each unique pair of microphones within the array, wherein the correlation is a true cross correlation utilizing both magnitude and phase;

comparing each SNC for each unique pair of microphones to a predetermined good correlation threshold (GCT) and a predetermined bad correlation threshold (BCT);

tagging each SNC as Good, Bad, or Undetermined, wherein Good (SNC>Good Correlation Threshold), Bad (SNC<Bad Correlation Threshold) or Undetermined (Bad Correlation Threshold<SNC<Good Correlation Threshold);

classifying the active microphone as a failed microphone or a working active microphone based on the tags, wherein the active working microphone is further classified as being an active working microphone operating under windy condition or an active working microphone operating under non-windy conditions;

generating a flag indicating that the classified active microphone is one of:

a failed microphone; and an active working microphone operating under windy conditions, or an active working microphone operating under non-windy conditions.

2. The method of claim 1, further comprising:

transitioning to another active microphone when the active microphone is determined to be classified as a failed microphone; and continue transitioning until an active working microphone determination is made.

3. The method of claim 1, wherein an active microphone flagged as being an active working microphone operating under windy conditions remains in operation.

4. The method of claim 1, wherein the generation of the smoothed normalized correlation (SNC) is independent of absolute energy levels.

5. The method of claim 1, wherein generating the smoothed normalized correlation (SNC), comprises:

acquiring an audio sample in a time domain from a pair of microphones within the array;

multiplying the audio samples for the pair of microphones together to generate a multiplication amount, retaining both magnitude and phase information for each microphone pair;

calculating a mean of the multiplication amount;

normalizing the calculated mean by a product of each microphone's root mean square (RMS) energy to generate a normalized result; and smoothing the normalized result with a low pass filter.

6. The method of claim 1, wherein using phase and amplitude based cross correlation between microphone pairs isolates up to N-2faulty microphones within the microphone array, where N is the number of microphones in the microphone array.

7. The method of claim 1, wherein the method avoids false triggering in response to wind noise.

8. The method of claim 1, wherein the classification is based on a matrix of the tags applied to microphone pairs in which an active masked matrix (AMM) is applied to the selected active microphone and an inverse masked matrix (IMM) is applied to the non-active microphones.

9. The method of claim 1, wherein the classification is based on a matrix of tags applied to microphone pairs in which an active masked matrix (AMM) is applied to the selected active microphone and an inverse masked matrix (IMM) is applied to the non-active microphones, wherein:

when the AMM has all Bad tags and IMM has at least one Good tag, then the active microphone is a failed microphone;

when the AMM has a Good tag, then the active microphone is good and operating under a non-windy condition;

when the AMM has all Bad tags and IMM does not have any Good tags, then the active microphone is good and operating in a windy condition;

when the AMM has at least one Undetermined, but no Good tags, then the active microphone is considered good, and wherein when the IMM has at least one Good tag, then the good active microphone is operating under a non-windy condition; and when the AMM has at least one Undetermined tag, but no Good tags, then the active microphone is considered good, in when the IMM does not have any Good tags, then the good active microphone is operating under a windy condition.

10. The method of claim 1, wherein the microphone array is located within a portable radio communication device.

11. The method of claim 10, further comprising:

tracking and storing flagged occurrences of failed microphones, flagged occurrences of active working microphones operating under windy conditions, and flagged occurrences of active working microphones operating in non-windy conditions as part of controller analytics of the portable radio communication device.

12. A portable communication device, comprising:

a microphone array having at least three microphones;

a controller operatively coupled to the microphone array;

a bandpass filter operatively coupled to the microphone array to remove DC (Direct Current) at a low predetermined frequency and remove uncorrelated components at a high predetermined frequency thereby generating a filtered signal; and wherein the controller generates a smoothed normalized correlation (SNC) for each unique pair of microphones within the microphone array, wherein SNC is a true cross correlation utilizing both magnitude and phase, each SNC for each unique pair of microphones being compared to predetermined thresholds and tagged as good correlation, bad correlation, and undetermined correlation;

the active microphone being classified, by the controller, as a failed microphone or an active working microphone based on the tags, wherein the active working microphone is further classified as being an active working microphone operating under a windy condition or an active working microphone operating under a non-windy condition; and the controller generating a flag indicative of each classification.

13. The portable communication device of claim 12, wherein the active microphone flagged as being an active working microphone operating under a windy condition remains in operation.

14. The portable communication device of claim 12, wherein the controller, in response to detecting a failed microphone, transitions to another microphone within the microphone array as a new active microphone. and the controller reclassifies the new active microphone.

15. The portable communication device of claim 12, where the portable communication device is a public safety radio.

16. The portable communication device of claim 12, further comprising:

a video recorder operatively coupled to the controller, and wherein at least one of the microphones from the microphone array records audio associated with video recorded by the video recorder.

17. The portable communication device of claim 12, wherein the controller generates the smoothed normalized correlation (SNC) for each unique pair of microphones within the array by:

acquiring an audio sample in a time domain from a pair of microphones within the array;

multiplying the audio samples for the two microphones together to generate a multiplication amount, retaining both magnitude and phase information for each microphone pair;

calculating a mean of the multiplication amount;

normalizing the calculated mean by a product of each microphone's root mean square (RMS) energy to generate a normalized result; and smoothing the normalized result with a low pass filter.

18. The portable communication device of claim 11, wherein the portable communication device is a public safety radio.

* * * * *